United States Patent [19]

Zacher

[11] Patent Number: 4,796,817

[45] Date of Patent: Jan. 10, 1989

[54] METHOD OF CONTROLLING A BOWL-MILL CRUSHER

[76] Inventor: H. Zacher, Am Loh 20, 6349 Greifenstein-Holzhausen, Fed. Rep. of Germany

[21] Appl. No.: 105,594

[22] Filed: Oct. 5, 1987

[30] Foreign Application Priority Data

Nov. 15, 1986 [DE] Fed. Rep. of Germany ..... 3639206

[51] Int. Cl.[4] ..... B02C 25/00

[52] U.S. Cl. ..... 241/18; 241/23; 241/24; 241/37; 241/119

[58] Field of Search ..... 241/33, 37, 34, 30, 241/117–121, 36, 18, 23, 24

[56] References Cited

U.S. PATENT DOCUMENTS 4,402,462 9/1983 Lohnherr ..... 241/37 X

*Primary Examiner*—Mark Rosenbaum

*Attorney, Agent, or Firm*—Max Fogiel

[57] ABSTRACT

A method of controlling a bowl-mill crusher that has cylinders that remain in one position and roll over a rotating bowl with a predetermined force. Raw coal and primary air are supplied to the crusher and the crushed coal is removed from the crusher along with the primary air through a separator and supplied to burners through a pulverized-coal line. The pressure of the primary air where it enters the bowl-mill crusher is controlled in accordance with load and in a manner so that the pressure of the crushing cylinders against the bowl is decreased in a predetermined manner when the desired load-dependent level is not attained and is increased when the level is exceeded.

8 Claims, 3 Drawing Sheets

METHOD OF CONTROLLING A BOWL-MILL CRUSHER

BACKGROUND OF THE INVENTION

The cylinders of bowl-mill crushers are oriented in relation to the bowl in such a way as to ensure that their total force will act on the material being crushed no matter how deep it is piled in the bowl. To establish the particular force that is to be exerted on the material in order to crush it, the cylinders are forced against the bowl at a particular pressure, the extent of which depends on how difficult the material is to crush. The pressure is maintained constant during the operation. When crushing difficult-to-crush coal with a low Hardgrove number and with a high percentage of fines in the rough-coal composition, the crusher may begin running erratically at certain stages and develop a considerable amount of vibration accompanied by noise. This erratic operation cannot be corrected satisfactorily by redesigning the crusher.

The object of the invention is to provide a method of controlling a bowl-mill crusher that will allow it to run quitely in all operating situations.

How smoothly a bowl-mill crusher runs depends on, among other factors, how full it is, a situation that is expressed in a loss of primary-air pressure between the intake into the crusher and the outlet from the burner or in other words in a particular primary-air pressure upstream of the crusher. It has been demonstrated that the air turbulence increases in spurts once the primary-air pressure exceeds a particular level. With this discovery as a point of departure accordingly, a method of controlling a crusher is proposed wherein the pressure of the cylinders is varied when the load-dependent primary-air pressure deviates from a prescribed level. This method can be exploited to drive a bowl-mill crusher quietly.

Figure 1:
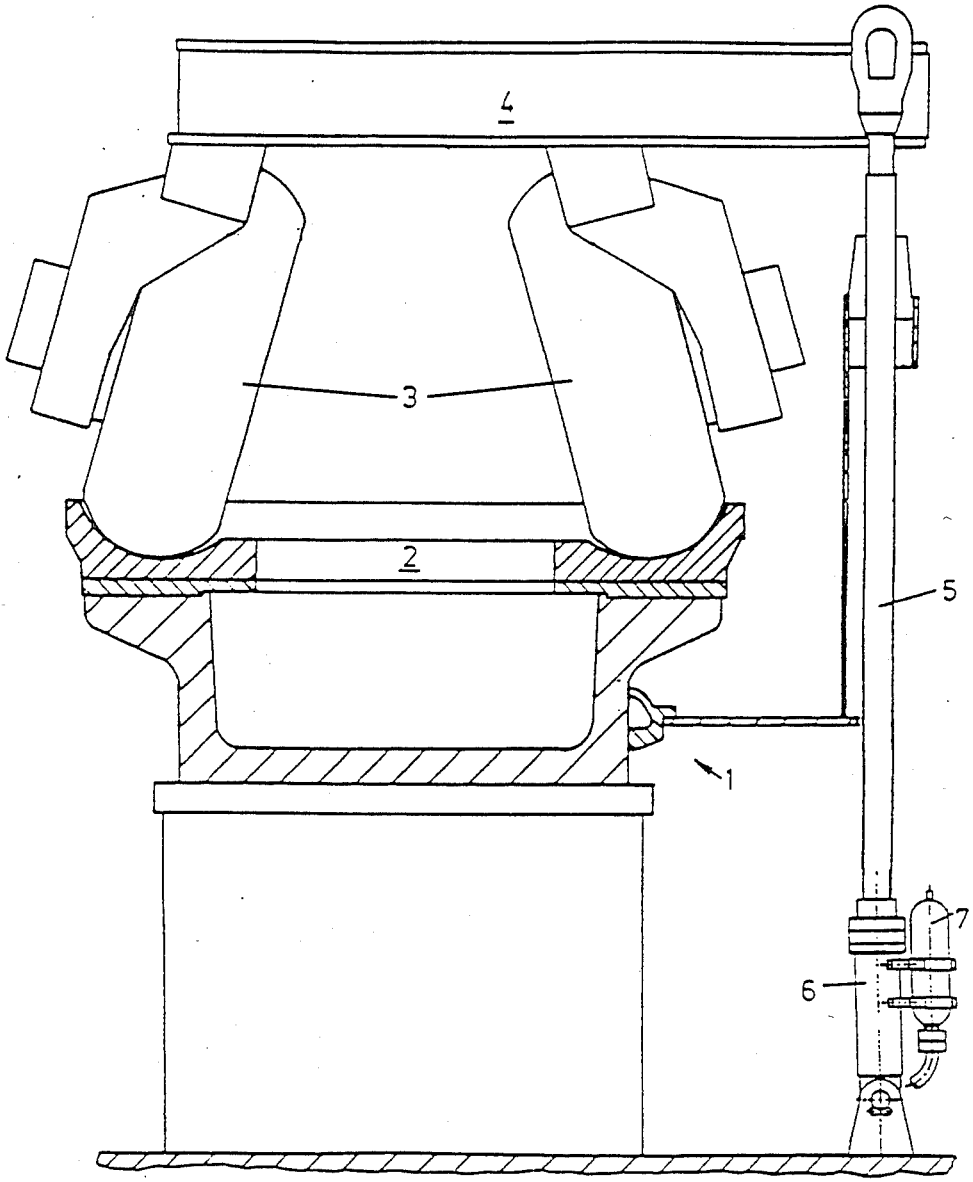
Figure 2:
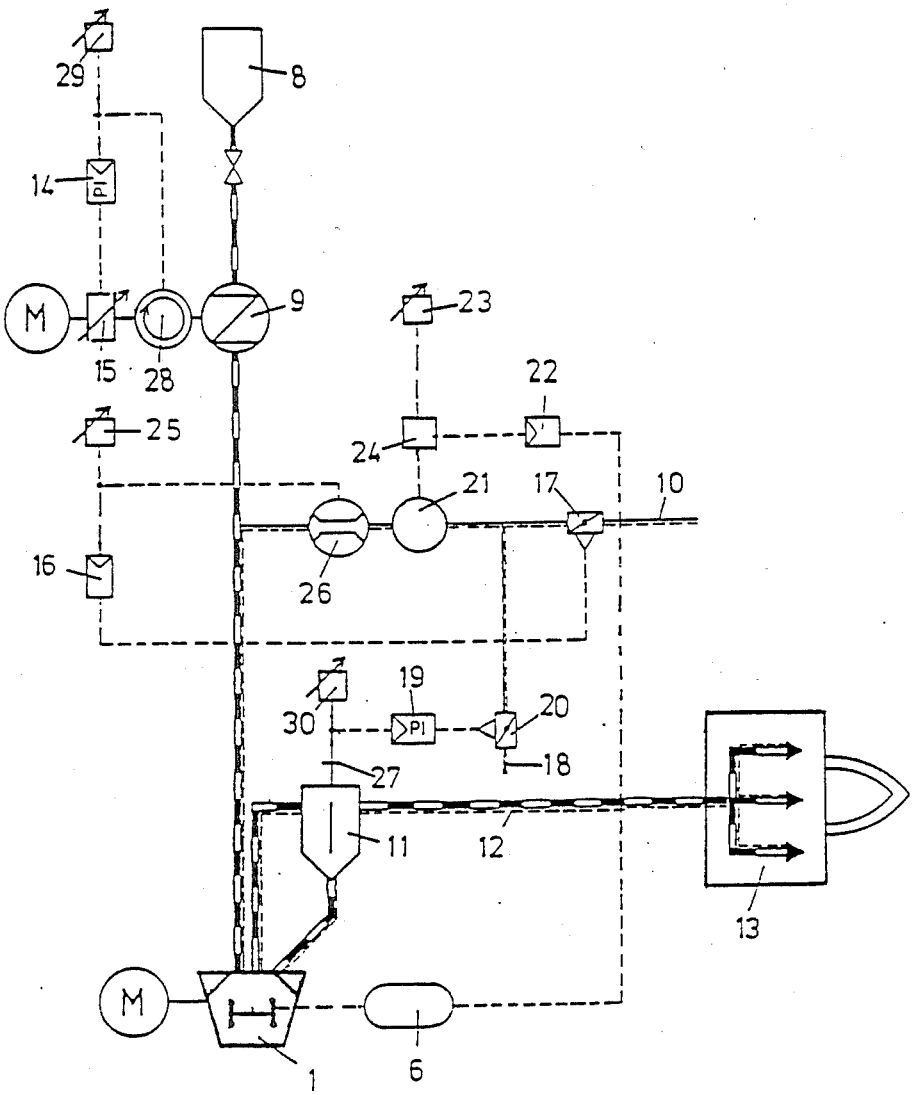
Figure 3:
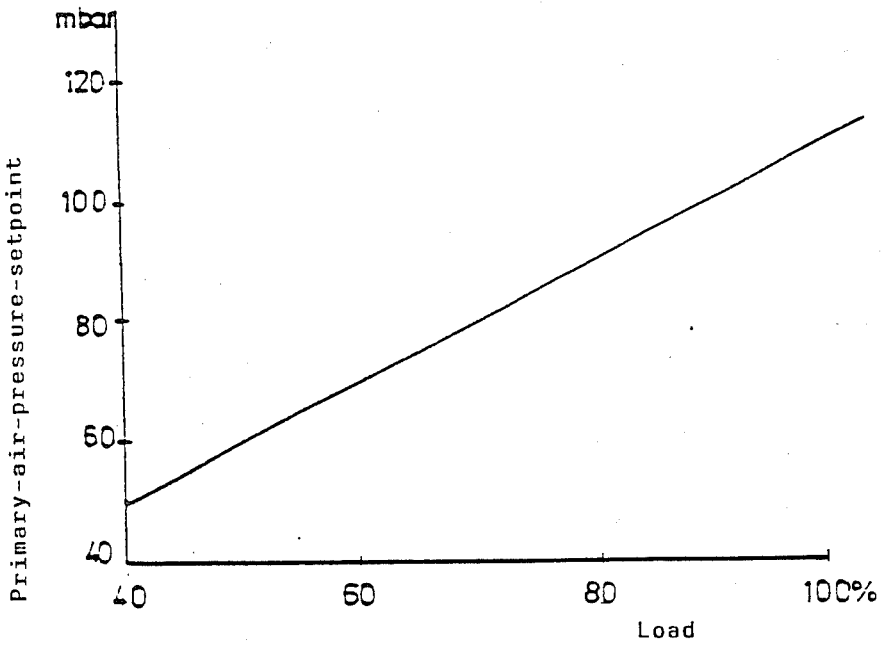
Figure 4:
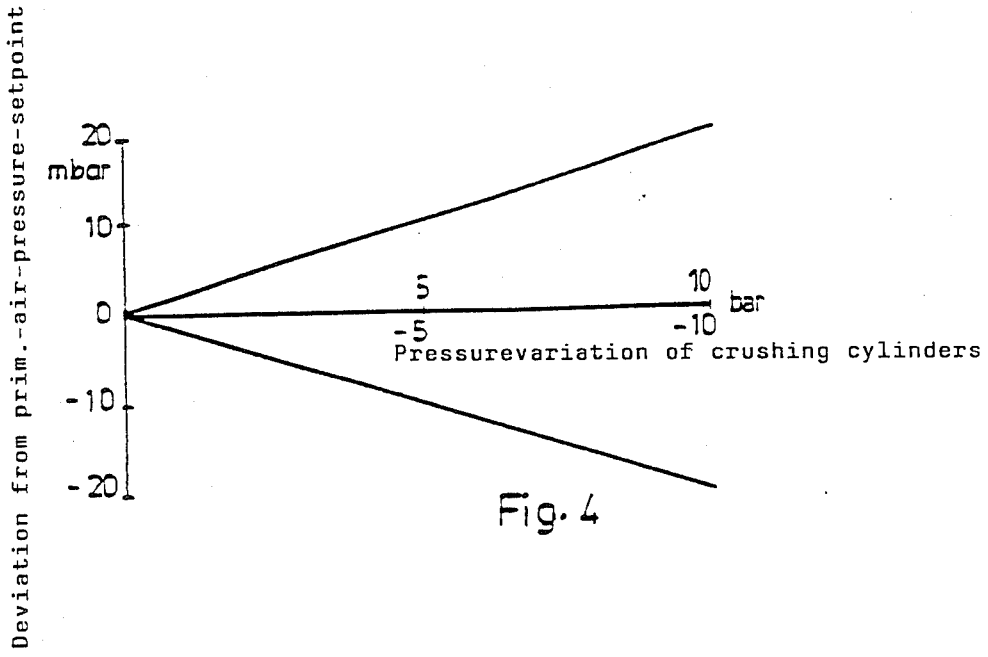

One embodiment of the invention will now be described with reference to the drawing, wherein FIG. 1 is a partly sectional schematic view of a bowl-mill crusher, FIG. 2 is a flow chart illustrating the control method in accordance with the invention, FIG. 3, is a graph illustrating how the primary-air/-pressure varies with load, and FIG. 4 is a graph illustrating how the cylinder pressure is to be varied in accordance with the primary air-pressure deviation.

The illustrated bowl-mill crusher 1 consists of a rotating bowl 2 and of cylinders 3 that remain in one position and roll over the bowl. The shafts of cylinders 3 are mounted on cylinder bearings in a frame 4. Three tie rods 5, only one of which is illustrated, engage frame 4 at three points.

Tie rods 5 are secured to the base by a system of hydraulic cylinders 6. The pressure of cylinders 3 against bowl 2 can be varied through tie rods 5 and frame 4 by supplying a pressure medium to hydraulic cylinders 6. A buffer 7 ensures that crushing cylinders 3 will yield resiliently.

Rough coal is supplied to bowl-mill crusher 1 from a hopper 8 through a distributor 9. Coal-drying and conveying gas in the form of heated primary air is injected through an air line 10. The crushed and dried coal is removed through a separator 11 and conveyed to the bureers of a furnace 13 through a pulverized-coal line 12. The output of coal in relation to load, the furnaceend consumption in other words, is established by level-setting controls 29 and carried out by coal-flow regulator 14. Coal regulator 14 acts on the variable drive mechanism 15 of distributor 9. The speed is monitored by an rpm sensor 28. The injection of primary air in accordance with load is established by level-setting controls 25 and carried out by a primary-air flow regulator 16 that acts on a primary-air control valve 17. The volume of primary air is monitored by a primary-air volumeter 26.

The temperature at separator 11 is established by level-setting controls 30 and monitored by a temperature sensor 27. To maintain the temperature at a prescribed level, cold air is mixed into the heated primary air from a cold-air line 18. The temperature of the separator is controlled by separator-temperature controls 19 that act on a cold-air control valve 20. There is a pressure gauge 21 in air line 10 between where cold-air line 18 enters and crusher 1. The pressure determined by gauge 21 equals the pressure of the primary air upstream upstream of where it enters bowl-mill crusher 1. Pressure gauge 21 communicates with pressure-to-load ratio-setting controls 23 and a comparison point 24. Comparison point 24 communicates with hydraulic cylinders 6 through pressure controls 22 to generate the pressure of the crushing cylinders.

Pressure-to-load ratio-setting controls 23 establish the desired primary-air pressure as a function of load in such a way that the pressure will follow the linear-function curve illustrated in FIG. 3. This curve is supplied to comparison point 24 and constantly compared with the actual level measured by pressure gauge 21. If the actual level deviates from the desired load-dependent level, the pump in the system of hydraulic cylinders 6 receives a pulse from pressure controls 22 and varies the pressure of crushing cylinders 3. As will be evident from FIG. 4, the pressure is decreased when the desired load-dependent primary-air pressure is not attained and increased when it is exceeded. The numerical quantities in FIG. 4 are intended to represent only the tendency to vary.

The control method described herein makes it possible to load the crusher to the extent desired, independent of the particular load situation that the crusher is being operated in, and to accordingly obtain enough of a crushing pad in bowl 2 to prevent the crushing cylinders from rolling directly over the bowl. This ensures that the bowl-mill crusher will operate quietly. The volume of primary air will also increase in the same direction as the load increases. Level-setting controls 25 that communicate with primary-air volumeter 26 will accordingly establish the desired volume of primary air, which increases with load. Separator-temperature controls 19 and cold-air control valve 20 will also increase the temperature (separator temperature) of the primary air at the exit from separator 11 as the load increases. The increase can range for example from 75° C. at a load of 40% to 85° C. at a load of 100%.

An increase in the load will be signaled to coal-level setting controls 29 and forwarded to primary-air level-setting controls in accordance with a constant function. The speed of distributor 9 increases and primary-air control valve 17 opens. The extent of variation is monitored by rpm sensor 28 and primary-air volumeter 26. Separator-temperature level-setting controls 30 simultaneously establish in accordance with a constant function a higher separator temperature, which is increased by closing cold-air control valve 20 and monitored by temperature sensor 27. A higher desired primary air-pressure level is likewise signaled to pressure-to-load ratio-setting controls 23 in accordance with a constant function.

If the detected primary-air pressure deviates from the desired level, pressure controls 22 supply a pulse to hydraulic cylinders 6 until the actual level equals the desired level.

I claim:

1. A method of controlling a bowl mill crusher having cylinders remaining in one position and rolling over a rotating bowl with a predetermined force, comprising the steps of supplying raw coal and primary air to the crusher; removing crushed coal from the crusher along with the primary air through a separator; supplying thereafter the crushed coal and primary air to burners through a pulverized-coal line; controlling the pressure of the primary air at entry of the bowl mill crusher according to a first function of load so that pressure of the crushing cylinders against the bowl is decreased according to a second function when a desired load dependent level is not attained. said pressure being increased when said level is exceeded said pressure being dependent on the amount of coal introduced into the mill said pressure being additionally corrected indirectly with respect to the supply of raw coal.

2. A method as defined in claim 1, wherein the volume of primary air is increased also a the load increases.

3. A method as defined in claim 1, and including the step of increasing the temperature at the exit from said separator as the load increases.

4. A method as defined in claim 1, including the step of providing a silo with a mass of coal filling said silo at predetermined levels, the level of coal in said silo being held constant when said pressure is varied indirectly with respect to the supply of raw coal.

5. A method as defined in claim 1, wherein said primary air has a desired pressure value in front of the mill, said desired pressure value of said primary air being transmitted dependent on the amount of coal introduced into the mill, in said desired pressure value of said primary air producing variation in said force.

6. A method as defined in claim 1, wherein the pressure of said primary air in front of said mill and within said mill is positive over the entire load range.

7. A method of controlling a bowl mill crusher having cylinders remaining in one position and rolling over a rotating bowl with a predetermined force, comprising the steps of: supplying raw coal and primary air to the crusher; removing crushed coal from the crusher along with the primary air through a separator; supplying thereafter the crushed coal and primary air to burners through a pulverized coal line; controlling the pressure of the primary air at entry of the bowl-mill crusher according to a first function of load so that pressure of the crushing cylinders against the bowl is decreased according to a second function when a desired load dependent level is not attained, said pressure being increased when said level is exceeded, said pressure being dependent on the amount of coal introduced into the mill, said pressure being additionally corrected indirectly with respect to the supply of raw coal; raw coal being supplied to said crusher from a hopper through a distributor; injecting heated primary air for coal drying and conveying through an air line; removing crushed and dried coal through said separator and conveying to burners of a furnace through a pulverized coal line; establishing coal output in relation to load by level setting controls operating in conjunction With a coal flow regulator: said coal regulator actuating a variable drive on said distributor with speed monitored by a speed sensor; said ingection of primary air in accordance with load being established by saidglevel setting controls and being carried out by a primary air flow regulator operating a primary-air control valve; monitoring the volume of primary air by a volumeter; establishing the temperature at said separator and monitoring said temperature for maintaining said temperature at a predetermined level by mixing cold air into said heated primary air; supplying said cold air from a cold air line entering said crusher; providing a pressure gauge where said cold air line enters said crusher. pressure indicated by said pressure gauge being equal to the pressure of said primary air upstream of where said primary air enters said crusher, said pressure gauge communicating with pressure-to load controls and a comparison joint communicating with said cylinders to generate pressure thereof; said pressure to load controls establishing a desired primary-air pressure as a function of load so that said pressure follows a predetermined linear function curve supplied to said comparison point and compared constantly with the actual pressure level measured by said gauge; supplying a pulse to said cylinders when the actual pressure level deviates from the desired load dependent level for varying said force, said pressure being decreased when the desired load dependent primary-air pressure is not attained and increased when it is exceeded: said crusher being loadable to a desired extent independent of an existing load condition that said crusher is being operated in, so that a sufficient crushing pad is produced in said bowl to prevent said cylinders from rolling directly over the bowl for producing quiet operation of said crusher.

8. A method of controlling a bowl mill crusher having cylinders remaining in on position and rolling over a rotating bowl with a predetermined force, comprising the steps of: supplying raw coal and primary air to the crusher; removing crushed coal from the crusher along with the primary air through a separator; supplying thereafter the crushed coal and primary air to burners through a pulverized coal line; controlling the pressure of the primary air at entry of the bowl mill crusher according to a first function of load so that pressure of the crushing cylinders against the bowl is decreased according to a second function when a desired load dependent level is not attained, said pressure being increased when said level is exceeded, said pressure being dependent on the amount of coal introduced into the mill, said pressure being additionally corrected indirectly with respect to the supply of raw coal; said crusher being loadable to a desired extent independent of an existing load condition that said crusher is being operated in to obtain sufficient crushing pad in said bowl for preventing said cylinders from rolling directly over the bowl to operate said crusher substantially quietly.

* * * * *